US010428650B2

(12) United States Patent
Shields

(10) Patent No.: US 10,428,650 B2
(45) Date of Patent: Oct. 1, 2019

(54) LAUNCH PLATFORM FOR HIGH WALL MINING

(71) Applicant: Midget Mining LLC, Prosperity, WV (US)

(72) Inventor: Randy C. Shields, Prosperity, WV (US)

( * ) Notice: Subject to any disclaimer, the term of this patent is extended or adjusted under 35 U.S.C. 154(b) by 87 days.

(21) Appl. No.: 13/896,309

(22) Filed: May 16, 2013

(65) Prior Publication Data

US 2013/0307315 A1 Nov. 21, 2013

Related U.S. Application Data

(60) Provisional application No. 61/647,695, filed on May 16, 2012.

(51) Int. Cl.

| | |
|---|---|
| ***E21F 13/08*** | (2006.01) |
| ***E21C 29/00*** | (2006.01) |
| ***E21C 41/16*** | (2006.01) |
| ***E21C 27/00*** | (2006.01) |
| *E21F 13/06* | (2006.01) |
| *E21F 13/00* | (2006.01) |

(52) U.S. Cl.

CPC ..... *E21C 29/00* (2013.01); *E21C 27/00* (2013.01); *E21C 41/16* (2013.01); *E21F 13/00* (2013.01); *E21F 13/06* (2013.01); *E21F 13/08* (2013.01)

(58) Field of Classification Search

CPC ..... E21F 13/00; E21F 13/06; E21F 13/08
USPC ..... 299/85.1, 18, 56, 57
See application file for complete search history.

(56) References Cited

U.S. PATENT DOCUMENTS

| | | | | |
|---|---|---|---|---|
| 2,698,169 A * | 12/1954 | Fawkes | 299/55 | |
| 3,897,976 A * | 8/1975 | Gallis | E21C 27/22 175/53 | |
| 3,918,536 A * | 11/1975 | Deeter et al. | 175/85 | |
| 4,118,072 A | 10/1978 | Kelley et al. | | |
| 4,150,853 A | 4/1979 | McCoy | | |

(Continued)

FOREIGN PATENT DOCUMENTS

| | | |
|---|---|---|
| AU | 662915 | 9/1995 |
| AU | 671935 B2 | 9/1996 |

(Continued)

OTHER PUBLICATIONS

Caterpillar Inc.; Highwall Mining System; 2011; pp. 1-8.

(Continued)

*Primary Examiner* — Sunil Singh
(74) *Attorney, Agent, or Firm* — Jonathan Brown

(57) ABSTRACT

A system and method for high wall bench mining, for example, of horizontal coal seams in mountains, includes a launch platform having two side-by-side tracks for guiding mining equipment, and utilizes two continuous miner machines and conveyor cars. Two side-by-side mine entries can be worked simultaneously, one miner advancing deeper into the coal seam and conveyor cars being added behind the miner at a first mine entry, and the mining completed and cars and miner retreating and being extracted from a second mine entry. As conveyor cars are being extracted onto one track from the mine entry that a string is retreating from, the cars are moved across the launch platform to the other track and are added behind the advancing miner machine launched from that track into the other mine entry.

17 Claims, 6 Drawing Sheets

(56) References Cited

U.S. PATENT DOCUMENTS

| | | | | |
|---|---|---|---|---|
| 4,441,761 | A | 4/1984 | Fields et al. | |
| 5,161,857 | A | 11/1992 | Mayercheck et al. | |
| 5,273,344 | A | 12/1993 | Volkwein et al. | |
| 5,709,433 | A | 1/1998 | Christopher et al. | |
| 5,782,539 | A * | 7/1998 | Peterson | E21C 41/18 299/11 |
| 5,810,447 | A | 9/1998 | Christopher et al. | |
| 5,879,057 | A | 3/1999 | Schwoebel et al. | |
| 5,967,616 | A | 10/1999 | Offutt et al. | |
| 6,652,035 | B2 * | 11/2003 | Chisholm | 299/18 |
| 7,594,702 | B2 | 9/2009 | Lowery | |
| 2004/0245843 | A1 | 12/2004 | Lowery | |
| 2004/0245844 | A1 | 12/2004 | Lowery | |
| 2004/0245845 | A1 | 12/2004 | Lowery | |
| 2004/0251732 | A1 | 12/2004 | Lowery | |
| 2008/0120926 | A1 | 5/2008 | Antoline et al. | |

FOREIGN PATENT DOCUMENTS

| | | |
|---|---|---|
| WO | 9633600 | 10/1996 |
| WO | 9748883 | 12/1997 |
| WO | 2004110915 | 12/2004 |
| WO | 2006075910 | 7/2006 |

OTHER PUBLICATIONS

ADDCAR; Highwall Mining System; Broad Bench Highwall System for Benches Over 90ft; retrieved Sep. 16, 2011 from <<http://www.addcarsystems.com/broad.html>>.

* cited by examiner

LAUNCH PLATFORM FOR HIGH WALL MINING

CROSS-REFERENCE TO RELATED APPLICATIONS

This is a nonprovisional patent application of U.S. Provisional Patent Application No. 61/647,695, filed May 16, 2012, and titled LAUNCH PLATFORM FOR HIGH WALL MINING, which is incorporated herein by reference.

BACKGROUND

The present invention relates to mining equipment, and more specifically to a launch platform for a high wall miner and conveyor cars and a method of high wall mining.

In high wall mining, for example of a coal seam in a mountain, a notch is cut in the side of the mountain at the elevation of the coal seam. This forms a flat surface, known as a bench, to work from and move equipment on, and a wall or face along which mine entries, also called shafts or rooms, are made into and along the coal seam. On the bench, a launch platform, also referred to as a table or deck, is used to push a continuous mining machine, also called a miner, forward against the high wall formed by the notch, cutting a mine entry horizontally into the coal seam.

As the miner is moved deeper in the coal seam, a coal conveyor car (for example, with a continuous web, belt, auger, or other conveyance to take away coal) is added behind the mining machine, and then behind each subsequent car, forming a mining string providing a continuous conveyor to remove coal as the miner cuts deeper into the wall. More specifically, generally a pair of cylinders, for example, hydraulic cylinders, can push each side of the miner and the subsequent conveyor cars connected in a string behind the miner. Often the maximum depth of the horizontal mine entry into the coal seam is limited by the length of the string formed by the cars behind the miner that can be effectively pushed by the hydraulic cylinders on the launch platform, for example, about 950 feet deep. Often the conveyor cars simply skid on the ground and thus significant friction and resulting resistance to advancement develops as more and more cars are added to the string behind the miner. Additionally, the maximum depth of the mine entry into the coal seam can be limited by the electrical current loss experienced in an excessively long power cable used to drive the mining head on the miner, for example, over about 800 feet of cable.

When the end of the coal seam or the maximum length of mining with the system used is reached, the conveyor cars are extracted one by one from the mine entry using the same launch platform and the same hydraulic cylinders. The extracted conveyor cars must be unhooked from the string, removed from the launch platform, and stowed. Such storage of conveyor cars on the narrow bench can be difficult when several dozen cars are used in a string.

After the miner is extracted, the launch platform is then moved sideways on the bench, along the face of the wall and next to the first mine entry just cut, to cut a target location for a second mine entry, with the second entry preferably extending parallel to the first entry. A pillar or supporting wall of coal is generally left between each pair of mine entries so that the mine entries do not collapse on the mining string under the weight of the overlying formation. However, because the launch platform hydraulic cylinders are used to advance the miner into the coal seam, for example, potentially pushing the miner from behind an 800 or 950 foot string of conveyor cars, it is difficult to ensure the side-by-side entries remain straight and parallel so that the pillars are not cut through into an adjacent entry. Such a cut through or too narrow of a pillar can result in subsidence of the overlying formation, trapping the miner and conveyor cars irretrievably.

Because of the height of a typical launch platform, in order for the miner to be advanced into the level of the coal seam, the bench must be downgraded below the level of the bottom of the coal seam, often by one or more feet. With a typical bench having a depth of 100 or more feet, this extra down downgrading removes a significant amount of material, material which must often be returned in order to again fill the bench and meet environmental and aesthetic requirements, thus greatly increasing the time and expense associated with the mining.

With the above described typical mining system and method, only one mine entry is being worked at any one time. Furthermore, during the extraction of the string after the maximum depth is reached in the coal seam, no coal is being cut or extracted because a second mine entry cannot be started until the entire extraction of cars and the miner is complete from the first mine entry, and the launch platform is moved to a new mine entry location adjacent the first mine entry.

SUMMARY

The present invention may comprise one or more of the features recited in the attached claims, and/or one or more of the following features and combinations thereof.

An illustrative embodiment of a system and method for high wall bench mining, for example, of horizontal coal seams in mountains, includes a launch platform having two side-by-side tracks for guiding mining equipment, and utilizes two continuous miner machines and conveyor cars. With the presently disclosed system and method, two side-by-side mines entries can be worked simultaneously, one miner advancing deeper into the coal seam and conveyor cars being added behind the miner at a first mine entry, and the mining completed and cars and miner retreating and being extracted from the second mine entry. As conveyor cars are being extracted onto one track from the mine entry from which a string is retreating from, the cars are moved across the launch platform to the other track and are added behind the advancing miner machine launched from that track into the other adjacent mine entry.

An illustrative launch platform for high wall bench mining of two side-by-side mine entries into a coal seam, includes a support frame spanning the two side-by-side mine entries; a first track coupled to the support frame and having a first pair of guides configured for guiding a miner and conveyor cars; a second track coupled to the support frame and having a second pair of guides configured for guiding a miner and conveyor cars; the first and second tracks parallel to one another and spaced to provide a pillar between the two side-by-side mine entries; a first conveyor coupled to the support frame and positioned between the first pair of guides of the first track; and a second conveyor coupled to the support frame and positioned between the second pair of guides of the second track.

The illustrative launch platform can further include a first ramp associated with the first track, the ramp pivotably coupled to the support frame on an end positionable closest to the mine entries; and an adjustable height canopy mounted over at least a portion of the first ramp. The illustrative launch platform can further include a third track coupled to the support frame and having a third pair of guides configured for shifting and guiding a conveyor car between the first and second tracks.

An illustrative system of high wall mining of a coal seam using continuous mining machines and conveyor cars, includes a launch platform including a first and a second track, the first and second tracks parallel to one another; a first target for a first mine entry is aligned with the second track, a first mining machine is associated with the first mine entry; and a second target for a second mine entry aligned is with the first track, a second mining machine is associated with the second mine entry; and wherein the process of mining the first, second and a third mine entry in the coal seam includes the steps of: advancing the miner and subsequent cars from the second track into the first mine entry; retreating and removing cars from the first mine entry onto the second track simultaneous with advancing the miner and subsequent cars from the first track into the second mine entry, including the steps of: each car removed from the first mine entry is retracted onto the second track; each car retracted onto the first track is shifted to the first track; each car shifted to the first track is advanced into the second mine entry; upon completion of advancing into the second mine entry and extracting all cars from the first mine entry, the launch platform is slid along the face of the mine entries so that the first track is aligned with the first mine entry, the miner is extracted from the first mine entry onto the first track, then the launch platform is slid along the face of mine entries so that the first track is aligned with a third mine entry and the second track is aligned with the second mine entry, and the above process repeated to simultaneously retreat from the second mine entry and advance into the third mine entry.

An illustrative method of mining first, second, and third side-by-side mine entries into a coal seam, including the steps of positioning a launch platform with a side-by-side first and second track for conveyor cars so that the second track is aligned with the first mine entry and the first track is aligned with the second mine entry; advancing the miner and subsequent cars from the second track into the first mine entry; retreating and removing cars from the first mine entry onto the second track simultaneous with advancing the miner and subsequent cars from the first track into the second mine entry, including the steps of: each car removed from the first mine entry is retracted onto the second track; each car retracted onto the first track is shifted to the first track; each car shifted to the first track is advanced into the second mine entry; upon completion of advancing into the second mine entry and extracting all cars from the first mine entry, the launch platform is moved along the face of the mine entries so that the first track is aligned with the first mine entry, the miner is extracted from the first mine entry onto the first track, then the launch platform is moved along the face of mine entries so that the first track is aligned with a third mine entry and the second track is aligned with the second mine entry, and the above process repeated to simultaneously retreat from the second mine entry and advance into the third mine entry.

Additional features of the disclosure will become apparent to those skilled in the art upon consideration of the following detailed description of the illustrative embodiments.

BRIEF DESCRIPTION OF THE DRAWINGS

The detailed description particularly refers to the accompanying figures in which.

DESCRIPTION OF ILLUSTRATIVE EMBODIMENTS

Figure 1:
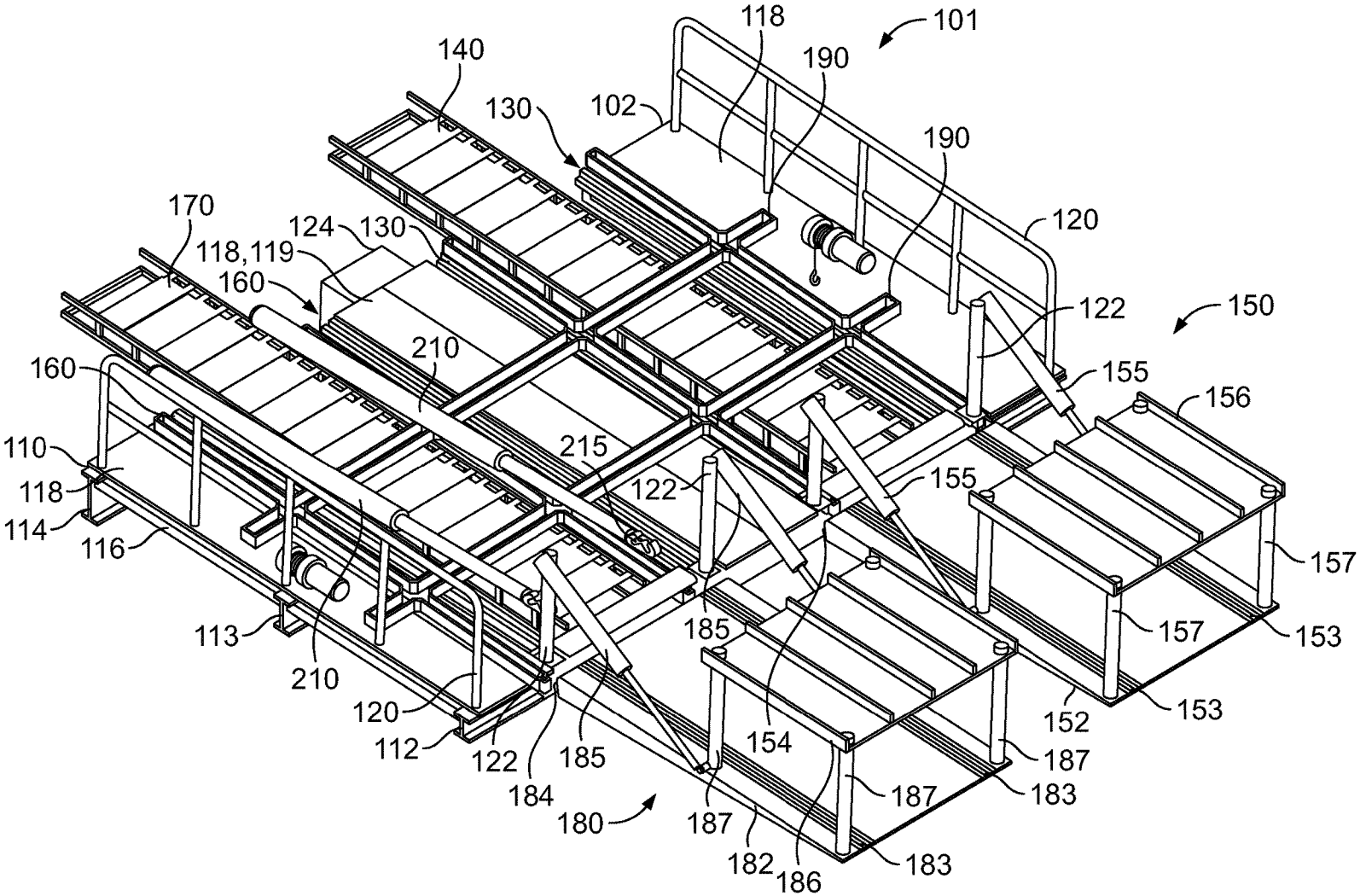
FIG. 1 is a perspective view of an illustrative embodiment of a launch platform according to the present invention.

For the purposes of promoting and understanding the principals of the invention, reference will now be made to one or more illustrative embodiments illustrated in the drawings and specific language will be used to describe the same.

FIG. 1 shows an illustrative launch platform 101 for high wall bench mining of side-by-side wall mine entries 20 and 22 (FIG. 2A), for example, into a horizontal coal seam 14 (FIG. 3A) in the side of a mountain. The illustrative launch platform 101 can also be used or can also be adapted for use with other types of mining, for example, longwall underground mining.

Figure 2A:
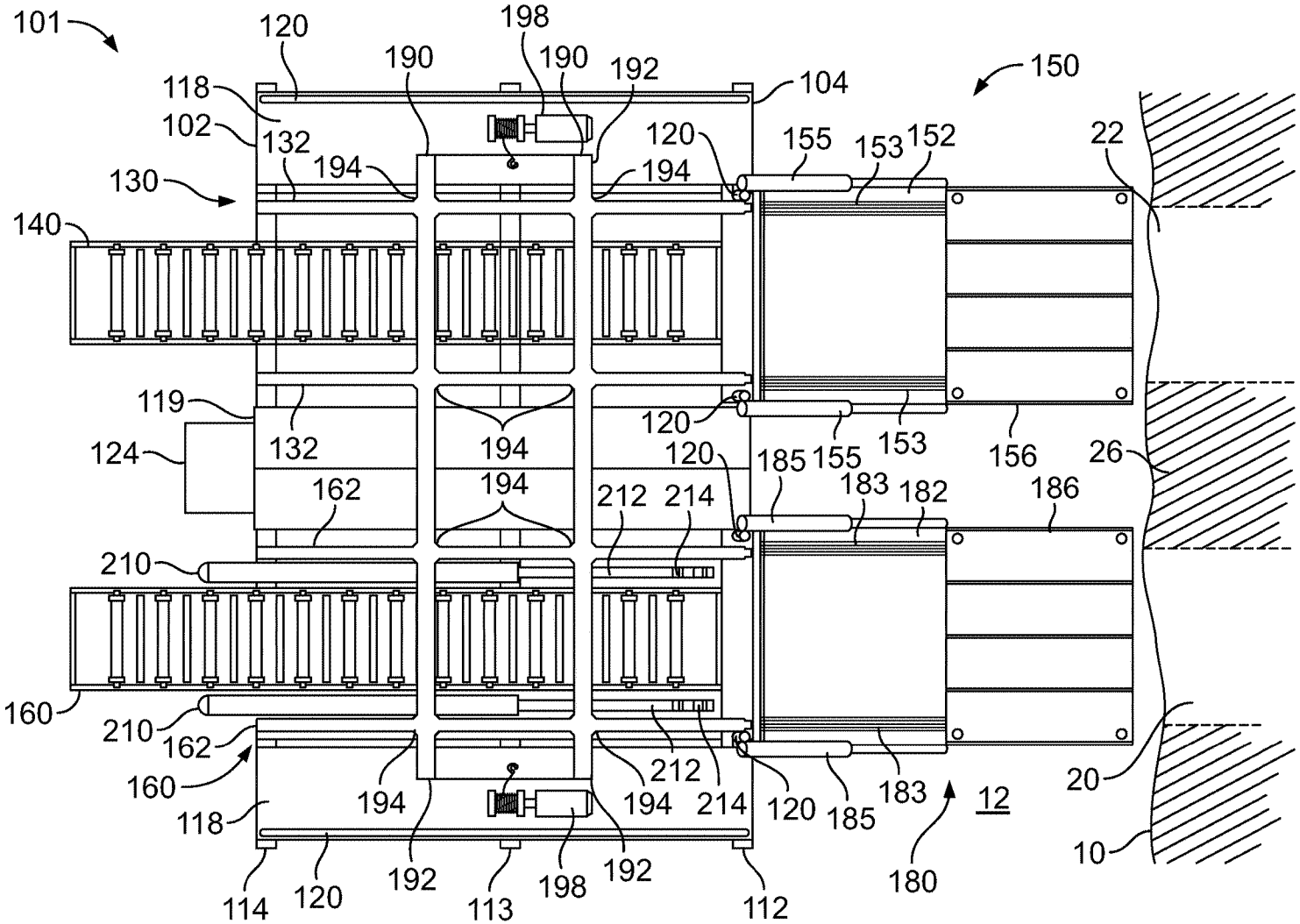
FIG. 2A is a top view of the illustrative launch platform of FIG. 1.

The launch platform 101 generally includes a support frame 110, a first track 130, a first conveyor 140, a first ramp 150, a second track 160, a second conveyor 170, a second ramp 180, and a cross track 190. Each of the first and second track 130 and 160 and their associated first and second ramps 150 and 180 provide for advancement and retraction of a mining equipment string 40 (FIG. 3B) relative to a mining entry 20, 22 (FIG. 2A). Referring again to FIG. 1, the first and second conveyors 140 and 170 remove mined material, for example chunks of coal, away from the mining entries 20 and 22 and toward the rear 102 of the launch platform 101 where some form of transportation or other conveyance is provided for the mined materials. In one embodiment, one of tracks 130 and 160 is only used for advancement of a mining equipment string 40 and the other of tracks 130 and 160 is only used for extraction of a mining equipment string 40.

In the illustrative embodiment, only the second track 160 includes extraction cylinders 210 that are used to extract the mining equipment string 40 (FIG. 3B) from a mine entry 20 and onto the second track 160. The first track 130 generally does not need to include extraction cylinders as the support frame 110 is intended to be used with a self-advancing miner 50 (FIG. 2B) that advances itself and the conveyor cars 70 behind it in the mining equipment string; however, in an alternative embodiment of the launch platform 101, the first track 130 includes cylinders for advancing a mining equipment string 40.

The cross track 190 provides for the shifting of conveyor cars 60 from the second track 160 to the first track 130. For example, as conveyor cars 60 are extracted from the mining equipment string 40 in the mine entry 20 (FIG. 2A) aligned with the second track 160, the conveyor cars can be shifted via the cross track 190 to the first track 130 to be advanced in the mining equipment string 42 in the mine entry 22 aligned with the first track 130, thus facilitating simultaneous continuous mining operations in both mine entries 20 and 22, for example, advancement in mine entry 22 during extraction from mine entry 20.

Figure 3A:
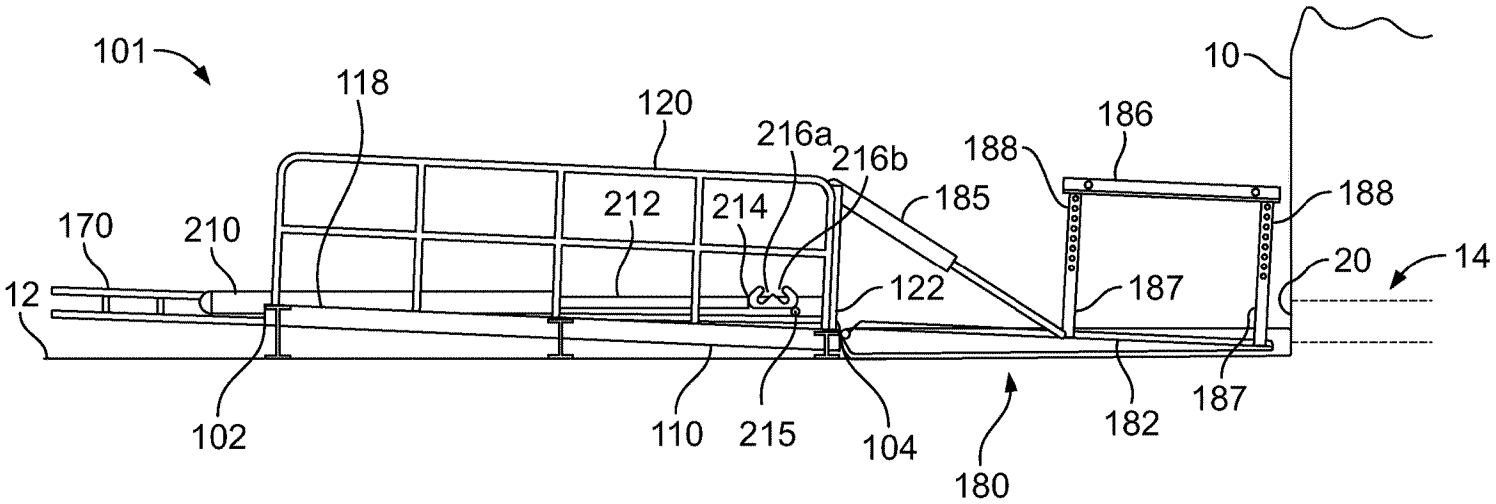
FIG. 3A is a side view of the illustrative launch platform of FIG. 1.
Figure 3B:
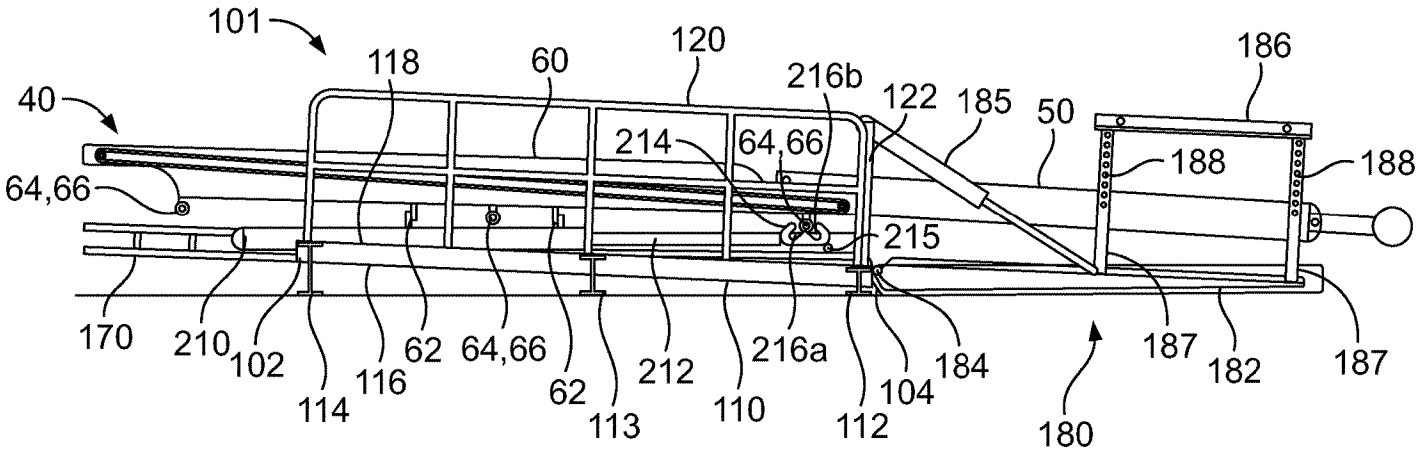
FIG. 3B is a partially exploded side view of the illustrative launch platform of FIG. 1 with mining equipment shown elevated slightly above the track.

Referring to FIG. 3A, the illustrative support platform 110 includes lateral I-beams 112, 113, and 114 extending across the width of the launch platform 101, I-beams 116 extending across the depth of the launch platform, flooring 118, and optional safety rails 120. The support platform 110 may also include a hydraulic power source 124, or a separate source of hydraulic fluid power may be utilized. Referring to FIGS. 3A and 3B, advantageously, the support platform 110 is sloped downward from a rear conveyance end 102 toward a mine entry end 104 that the ramps 150 and 180 are pivotably attached to. The slope can be provided, for example, by I-beams 112, 113, and 114 being different heights. The downslope toward the mine entry end 104 allows a miner 50 advanced off of the launch platform 101 to be at a level even with the bottom of the coal seam 14, thus reducing or eliminating the necessity to downgrade the bench 12 significantly below the level of the coal seam 14.

Referring to referring to FIG. 1, the first ramp 150 and the second ramp 180 can generally be identical and will therefore be described simultaneously. The ramps 150 and 180 include a base 152 and 182 that is pivotably hinged by a pivot connector 154 and 184 to the support platform 110. Canopies 156 and 186, that protect at least a portion of the ramps 150 and 180 from falling debris, are each supported by four risers 157 and 187. The height of the canopies 156 and 186 is adjustable, for example, by pinning the canopy in position in one of the selected apertures 158 and 188 formed in risers 157 and 187. The base 152 and 182 can include a pair of guides 153 and 183 (or tracks) that receive and guide wheels or another portion of structure of the miner 50 and conveyor cars 60 to keep the miner and cars laterally aligned with the mine entry 20 and 22.

The slope of the ramps 150 and 180 is adjustable relative to the support frame 110 and the bench 12. Thus, the height at which the mining equipment string 42, including the miner 50, comes off of the ramp and into the mine entry 20 and 22 can be adjusted as desired based on the height of the bench 12 relative to the coal seam 14. For example, the floor 152 and 182 of the ramp 150 and 180 can be rotated about the pivot 154 and 184 by a pair of hydraulic cylinders 155 and 185 coupled between the base 152 and 182 and vertical posts 122 that are coupled to the support platform 110 and selectively driven by the hydraulic power supply 124.

Figure 2B:
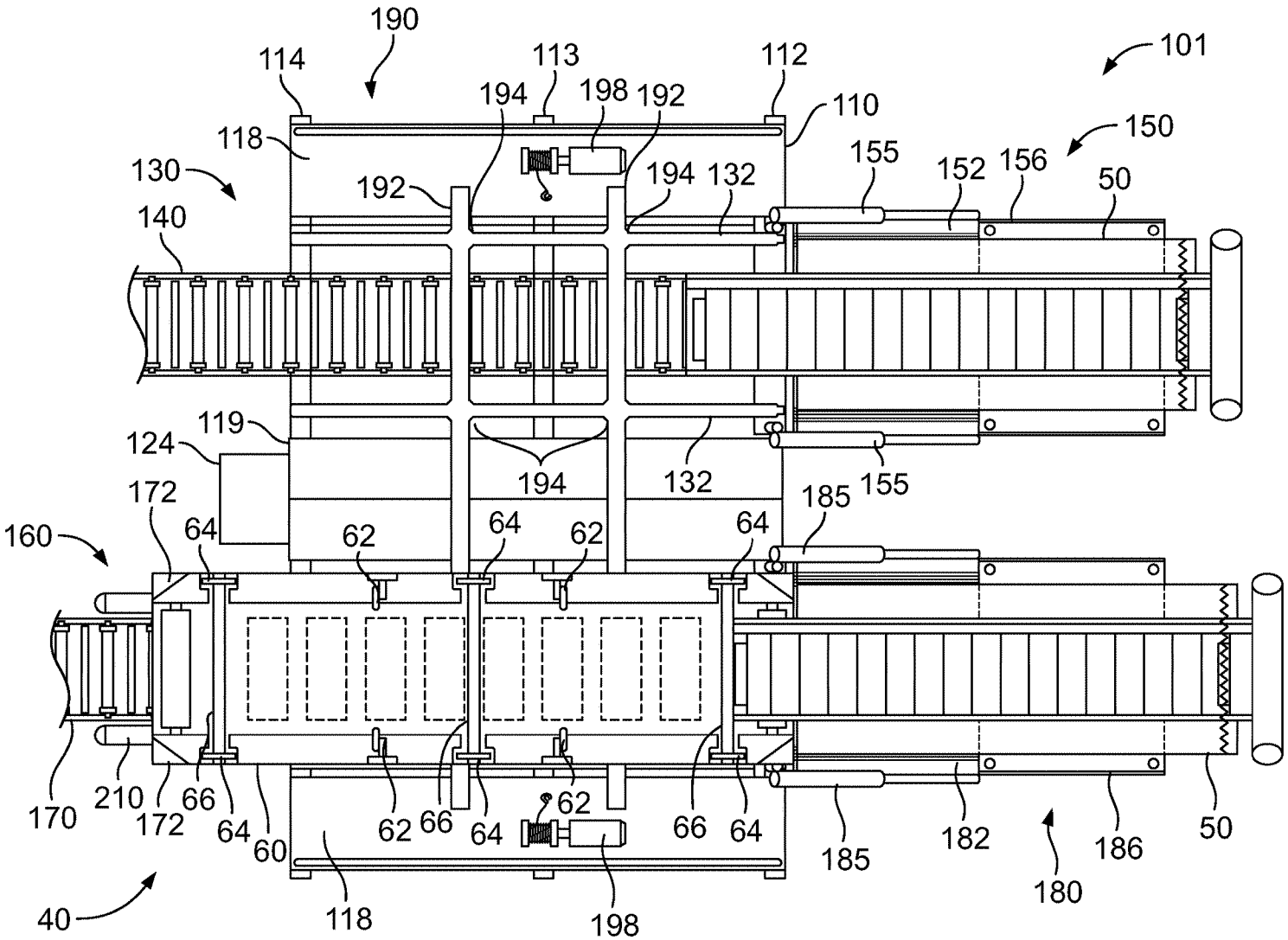
FIG. 2B is a top view of the illustrative launch platform of FIG. 1 with mining equipment shown on the tracks.

Referring to FIG. 2A and 2B, the first track 130 is coupled to the support frame 110 and is generally used to advance the self-advancing miner 50 and subsequent conveyor cars 60 (FIG. 2*b*) coupled behind the miner into a mining equipment string 42 into the one of the mine entries 20 or 22 that the first track 130 is then aligned with. The second track 160 is coupled to the support frame 110 and is generally used to extract the conveyor cars 60 coupled behind the miner 50 in a mining equipment string 40 from the one of the mine entries 20 or 22 that the second track 160 is then aligned with. The retreat and extraction of the cars 60 and miner 50 is provided by a pair of hydraulic extraction cylinders 210 (FIGS. 1 and 3B) as will be discussed further below.

Each track 130 and 160 includes a pair of guides 132 and 162 that are configured for guiding a miner 50 and conveyor cars 60 by receiving and guiding wheels or another portion of the structure of the miner 50 and conveyor cars 60, keeping the miner and cars laterally aligned with the mine entry 20 and 22, and facilitating keeping the entries 20 and 22 parallel along their full depth. The guides 132 and 162 are also aligned with guides 153 and 183 on the ramps 150 and 180. In the illustrated embodiments, each respective pair of guides 132 and 162 are spaced about 42 inches apart, and the spacing between the centerlines (not shown) of the tracks 130 and 160 is about 12 feet.

By providing for lateral guidance of the miner 50, the space between the mine entries 20 and 22, which is generally a pillar 26, is kept intact and of sufficient width along the full depth of the miner entries 20 and 22 into the coal seam 14 to prevent collapse of the mine entries 20 and 22 due to the weight of the overlying formations. For example, the guides 132 and 162 may provide a channel in which the wheels of the miner 50 and conveyor cars 60 are retained and guided. Alternatively, the guides 132 and 162 may provide rail on which or along which the wheels of the miner 50 and conveyor cars 60 are guided.

The spacing between the parallel sets of tracks 130 and 160 is determined by the width of the peg 119 portion of the support frame 110. For example, in the illustrative embodiment, the width is about 48 inches. Depending on the desired pillar 26 width in the coal seam 14, a wider or narrower peg 119 can be utilized. In one illustrative embodiment, the width of peg 119 is adjustable or pegs of varying width 119 are interchangeable in order to vary the spacing between the tracks 130 and 160, thus providing a selected pillar 26 width.

The launch platform 101 may also include a transfer system for moving and guiding conveyor cars 60 between the first and second tracks 130 and 170. For example, for moving an conveyor car 60 that has been extracted from the mine entry 20 and onto the second track 160, across the peg 119 and onto the first track 130, so that the conveyor car may be added to and advanced with the advancing mining equipment string 40 into the mine entry 22. For example, the transfer system can include a third track, cross track 190, that is also coupled to the support frame 110 and includes a pair of guides 192.

The guides 192 may provide a channel in which a set of transverse wheels 62 of the conveyor cars 60 are retained and guided. Alternatively, the guides 192 may provide a rail on which or along which the transverse wheels 62 of the conveyor cars 60 are guided. Where the guides 192 intersect with the guides 132 and 162, a T or X intersection 194 is formed as shown in FIG. 2A. The set of transverse wheels 62, shown in FIG. 2B and 3B, can be hydraulically actuated to extend downward below the conveyer car 60 and into the guides 192, elevating the car so that the advance wheels 64 are clear of the guides 132 and 162 of the first and second tracks 130 and 160, thus allowing the transverse wheels 62 to guide and bear the weight of the car 60 transversely from the second track 160 to the first track 130.

Winches 198, for example, hydraulic winches selectively actuated by the hydraulic power source 124, can be used to pull the car 60 transversely across the launch platform 101. Upon the car 60 being positioned over the first track 130 and the advance wheels 64 being aligned with the guides 132, the transverse wheels 62 can be actuated to swing upward and out of the way, allowing the car 60 to lower and the advance wheels 64 to engage with the rails 132, bearing the weight of the car 60.

In an alternative embodiment, the track guides 132 and 162 or the wheels 64 retract downward or upward respectively, allowing the car 60 to be transversely moved from track 160 to track 130. In an additional alternative embodiment, the guides 192 extend upwardly to lift the car 60 so that the advance wheels 64 are clear from the guides 132 and 162 so that the car 60 can be moved on guides 192 transversely from track 160 to track 130.

Figure 4:
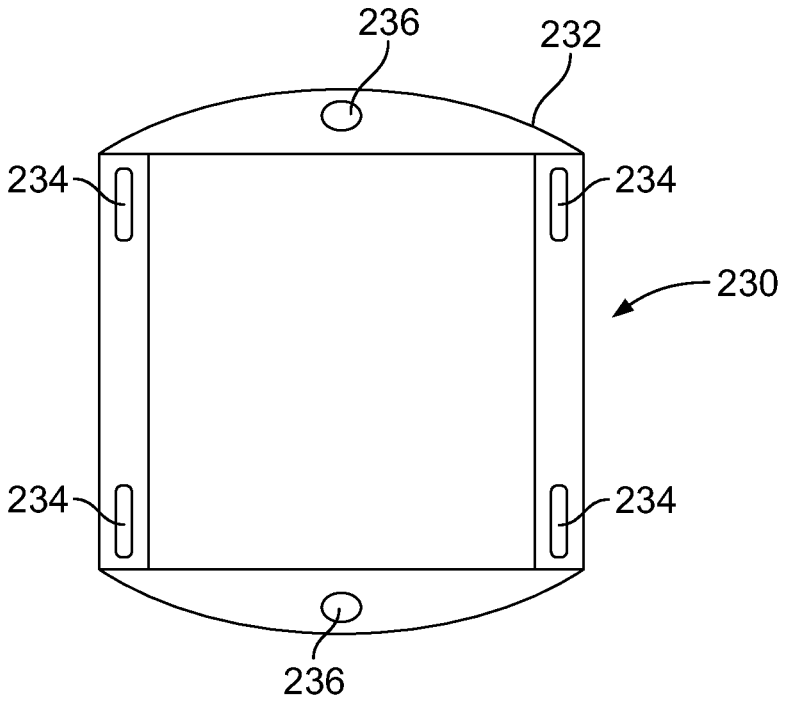
FIG. 4 is a top view of an optional conveyor car dolly used in conjunction with the illustrative launch platform of FIG. 1.

In yet another alternative embodiment of the launch platform 101 and car 60, rather than transverse wheels 62 included with car 60, a dolly 230 as shown in FIG. 4 is used to carry the car 60 from the second track 160 to the first track 130. For example, the car 60 can be elevated vertically to allow the dolly 230 to be inserted under it using a fork lift, crane, or other lift device. The wheels 232 of the dolly 230 can by guided by the guides 192. When the car 60 is aligned with the first track 130, the car 60 can be elevated vertically again to allow the dolly 230 to be extracted from under it, and then car lowered so that the advance wheels 64 engage with the guides 132 of the first track 130. An illustrative dolly 230 can include body 232, wheels 234 that can be received and guided by guides 192, and winch points 236. In another alternative embodiment, a lift or crane either coupled with or separate from the launch platform 101 can be used to load cars 60 onto one of tracks 130 and 160 and to shift the cars 60 between the tracks.

Referring to FIGS. 1 and 2A, a first conveyor 140 is coupled to the support frame 110 and is positioned between the first pair of guides 132 of the first track 130. A second conveyor 170 is coupled to the support frame 110 and is positioned between the second pair of guides 162 of the second track 160. In FIG. 1, the web or belt of conveyors 140 and 170 are show, and in FIGS. 2A and 2B, the web or belt are removed to illustrate the roller supports.

The conveyors 140 and 170 may be a beltline type conveyor of about 36 feet in length, and detachable from the support frame 110 for more convenient transport of the launch platform 101. The conveyors 140 and 170 extend from the wall end 104 of the launch platform 101 and continue past the rear end 102 opposite the wall 10. Advantageously, as the end of a conveyor car 60 is at any position along the length of the launch platform 101 as the car is being advanced in the mine entry 20 or 22, or as the car is being extracted from the mine entry 20 and coal is still being conveyed on the mining equipment string 40, the conveyor 60 extending across the depth of the launch platform 101 will ensure that the coal is collected and not wasted.

Referring to FIGS. 2A and 3B, the extraction cylinders 210 associated with the second track 160 are used to extract the retreating mining equipment string 40. Although the cylinders 210 can also be used to advance the mining equipment string 42, this use is optional as a self-advancing miner 50 can be used to pull the advancing mining equipment string 42 into the mine entry 22. The cylinders 210 can include a cylinder rod 212 and a ratchet 214 coupled to the distal end of the rod 212. As shown in FIGS. 3A and 3B, ratchet 214 can be bidirectional, having a recess 216a for engaging the axle 66 or other member of the conveyor car 60 and advancing the car and coupled mining equipment string 42 toward the mine entry 20, 22 and recess 216b for engaging the axle 66 or other member of the car and retreating the car 60 and coupled mining equipment string 40 from the mine entry 20, 22. Advantageously, the extraction cylinders 210 can be driven by the hydraulic power source 124, and can be controlled as is known in the art so that the rods 212 extend equally and simultaneously so as to keep the mining equipment string 40, 42 straight and the wheels 64 within the track guides 162.

Detachment of the conveyors 140 and 170, which can be, for example, about 36 feet long, provides for movement and repositioning of the launch platform between benches 12, including transport on vehicle highways. After detachment of the conveyors, and the ramps are folded upward or detached, for the illustrative embodiment, the depth of the platform along the length of the tracks 130 and 170, between ends 102 and 104 is about 16 feet, and the width is about 24 feet, which will allow permitting and movement on most public roads. In one illustrative embodiment, the support frame 110 divides so that the first track 130, conveyor 140, and ramp 150 can be separated from the second track 160, conveyor 170, and ramp 180. In such an embodiment, the support frame 110 includes alignment and coupling hardware to ensure the tracks 130 and 140 are parallel when the two halves of the support frame are coupled. Additionally, the support frame 110 may include such alignment and coupling hardware on both sides of each half for the tracks 130 and 160 so that one track, for example the first track 130 can be left in position, and the other track 160 uncoupled, moved to the opposite side, and recoupled.

Typical prior art launch platforms are about 40 feet in depth or longer, in order to accommodate typical miner length of about 36 feet. With these miners typically being loaded onto such prior art launch platforms from the rear end, opposite the mine wall 10, the required bench in the prior art is generally more than 90 feet in depth from wall 10. With the present launch platform 110, and using miners 50 and cars 60 about 20 feet in length, and miners cars loaded onto the launch platform from the side or from the rear end 102, a bench 12 of only about 40 feet is required, providing a significant advantage in how much material must be moved in forming and in restoring the bench.

The launch platform 101 can be constructed primarily of steel, however, other rigid materials are contemplated and can be selected by a person of ordinary skill in the art based on considerations such as strength, durability, weight, cost, and ease of construction and maintenance.

An illustrative method 300 of high wall mining of a coal seam using continuous mining machines and conveyor cars and the illustrative embodiment 101 is shown in schematic form in FIGS. 5A-5D.

Figure 5A:
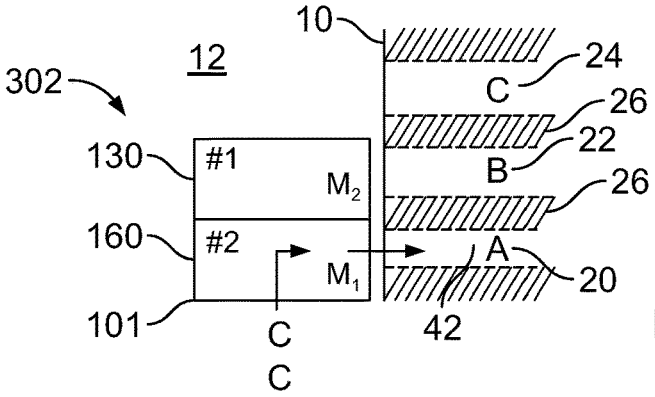
FIGS. 5A-5D is a schematic representation of steps of an illustrative method of mining associated with the illustrative launch platform of FIG. 1.

Referring to FIG. 5A, in step 302, a second track 160 is aligned with a first target for a first mine entry 20 in wall 10. The second track 160 can have positioned thereon a first miner M1. A first track 130 is aligned with a second target for a second mine entry 22 in wall 10. The first track 130 can have positioned thereon a second miner M2. The first miner M1 is advanced into the mining entry 20, for example a self-advancing miner 50, and conveyor cars 60 are subsequently positioned onto the second track 160, behind the advancing miner M1 and coupled thereto, forming advancing mining equipment string 42, until the complete desired depth of the mine entry 20 is reached.

Figure 5B:
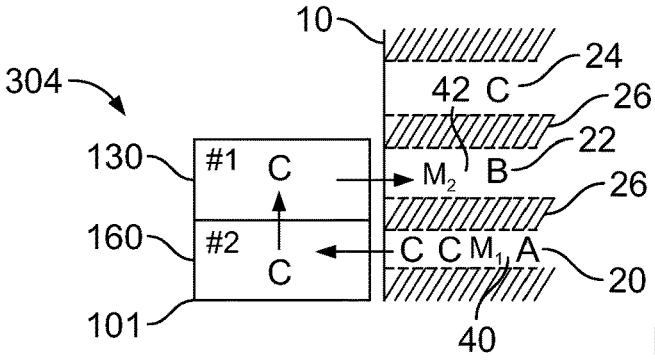

Referring to FIG. 5B, in step 304, retreating and removing cars 60, from the now retreating equipment string 40, from the first mine entry 20 onto the second track 160 is completed simultaneous with advancing the miner M2 and subsequent cars 60, forming advancing equipment string 42 from the first track 130 into the second mine entry 22. Each car 60 is extracted from the mine entry 20, for example by actuation of the extraction cylinders 210 coupled with the car 60 on the ramp 180 and entering the track 160, thus retracting car 60 fully onto the guides 162 of the support frame 110. Once a particular car 60 is fully supported by the support frame 110, and the advancing mining equipment string 42 advancing into the mine entry 22 has cleared the track 130, the miner M2 or last subsequent coupled car 60 being on the ramp 150, the car 60 on the track 160 is uncoupled from the retreating mining equipment string 40 and is transversely shifted to the track 130, as shifted above, and coupled with the advancing mining equipment string 42.

Figure 5C:
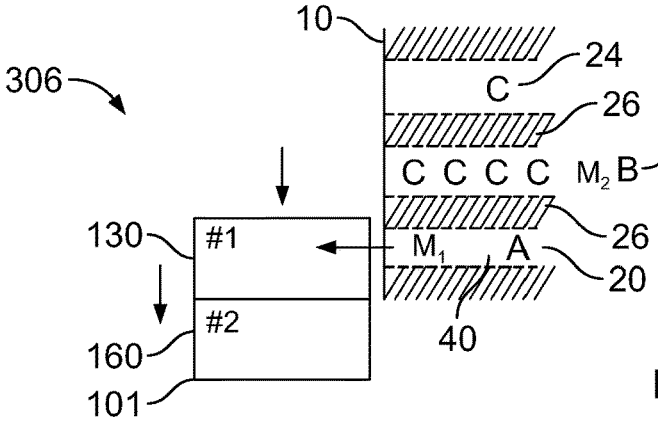

Upon completion of extraction of all car 60 of the retreating mining equipment string 40 from the mine entry 20, and completion of the advancing mining equipment string 42 into the mine entry 22 such that the launch platform 101 tracks 130 and 160 are empty, as shown in FIG. 5C, in step 304, the launch platform is slid along the wall 10 of the mine entries so that the first track 130 is aligned with the first mine entry 20, and the miner M1 is extracted from the first mine entry onto the first track.

Figure 5D:
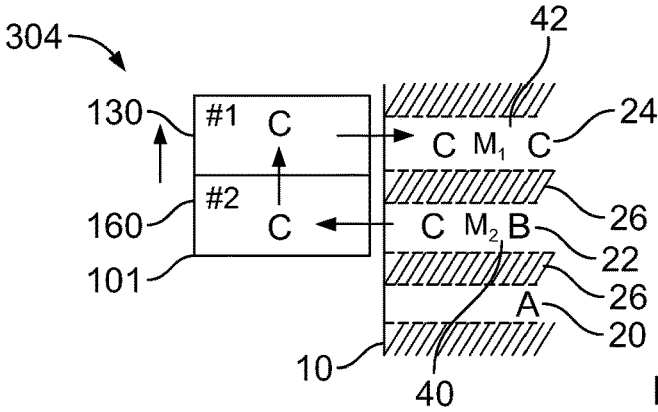

Referring to FIG. 5D, in step 308, the launch platform 101 is slid along the wall 10 of mine entries so that the first track 130 is aligned with a third mine entry 24 and the second track 160 is aligned with the second mine entry 24, and the above and steps 304, 306 and 308 are repeated to simultaneously retreat from the second mine entry 22 and advance into the third mine entry 24, and any such subsequent mine entries (not shown).

Although the illustrative embodiments relate to high wall mining, the inventive concept can be used with or adapted as is known in the art to be used with other types of mining, including longwall, room & pillar, and surface mining.

While the invention has been illustrated and described in detail in the foregoing drawings and description, the same is to be considered as illustrative and not restrictive in character, it being understood that only illustrative embodiments thereof have been shown and described and that all changes and modifications that come within the spirit and scope of the invention as defined in the claims and summary are desired to be protected.

The invention claimed is:

1. A system of high wall mining of a coal seam using continuous mining machines and conveyor cars, comprising:

a launch platform including a first track and a second track for supporting the mining machines and conveyor cars;

a first target for a first mine entry aligned with the second track; and a second target for a second mine entry aligned with the first track;

a transfer system for moving conveyor cars between the first track and the second track, and further comprising a peg portion of the launch platform, wherein the peg portion of the launch platform is capable of adjusting the width between the first track and the second track.

2. The system of high wall mining of claim 1, further comprising;

a first conveyor coupled to the launch platform and collocated with the first track; and second conveyor coupled to the launch platform and collocated with the second track.

3. The system of high wall mining of claim 1, wherein the first and second tracks are parallel to one another.

4. The system of high wall mining of claim 1, further comprising at least one extraction cylinder associated with at least one of the first and second tracks.

5. The system of high wall mining of claim 1, further comprising a first mining machine associated initially with the first entry, and a second mining machine associated initially with the second mine entry.

6. The system of high mining of a coal seam of claim 1, wherein the launch platform is further comprised of:

a support frame capable of spanning the two side-by-side entries;

wherein the first track is coupled to the support frame and has a first pair of guides for guiding a miner and conveyor cars, and wherein the second track is coupled to the support frame and has a second pair of guides for guiding a miner and conveyor cars.

7. The system of high wall mining of a coal seam of claim 6, further comprising:

a first conveyor coupled to the support frame and positioned between the first pair of guides of the first track; and a second conveyor coupled to the support frame and positioned between the second pair of guides of the second track.

8. The system of high wall mining of a coal seam of claim 6, wherein the first and second tracks are parallel to one another and spaced to provide a pillar between the two side-by-side mine entries.

9. The system of high wall mining of a coal seam of claim 6, further comprising a first ramp associated with the first track, the ramp pivotally coupled to the support frame on an end positionable closest to the mine entries.

10. The system of high wall mining of a coal seam of claim 9, further comprising an adjustable height canopy mounted over at least a portion of the first ramp.

11. The system of high wall mining of a coal seam claim 6, further comprising a third track coupled to the support frame and having a third pair of guides for shirting and guiding a conveyor car between the first and second tracks.

12. The system of high wall mining a coal seam of claim 6, further comprising a dolly for shifting conveyor cars between the first and second tracks.

13. The system of high wall mining of a coal seam of claim 6, further comprising a lift coupled to the support frame, the lift for shifting and guiding a conveyor car between the first and second tracks.

14. The system of high wall mining of a coal seam of claim 6, further comprising at least one extraction cylinder associated with at least one of the first and second tracks.

15. A method of mining a first and a second side-by-side mine entries into a seam to be mined, comprising the step of:

positioning a launch platform with a side-by-side first and second track for conveyor cars so that the second track is aligned with the first mine entry and the first track is aligned with the second mine entry;

providing a peg portion of the launch platform, wherein the peg portion of the launch platform is capable of adjusting the width between the first track and the second track, advancing a first miner and conveyor cars from the second track into the first mine entry;

retreating the conveyer cars and moving cars from the first mine entry onto the second track simultaneous with advancing a second miner and conveyor cars from the first track into the second mine entry, including the steps of:

retracting each conveyor car removed from the first mine entry onto the second track;

shifting each conveyor car retracted onto the second track to the first track; and advancing each conveyor car shifted to the first track into the second mine entry.

16. A method of mining a first and a second side-by-side mine entries into a seam to be mined, comprising the steps of:

positioning a launch platform with a side-by-side first and second track for conveyor cars so that the second track is aligned with the first mine entry and the first track is aligned with the second mine entry;

advancing a first miner and conveyor cars from the second track into the first mine entry;

retreating and removing cars from the first mine entry onto the second track simultaneous with advancing a second miner and conveyor cars from the first track into the second mine entry, including the steps of:

removing each conveyor car from the first mine entry and retracting it onto the second track;

shifting each conveyor car retracted onto the second track to the first track; and advancing each conveyor car shifted to the first track into the second mine entry and further comprising the steps of:

upon completion of advancing into the second mine entry and extracting all conveyor cars from the first mine entry, moving the launch platform along the face of the mine entries so that the first track is aligned with the first mine entry, extracting the first miner from the first mine entry onto the first track, and moving the launch platform along the face of mine entries so that the fast track is aligned with a third mine entry and the second track is aligned with the second mine entry.

17. The method of mining of claim 16, further comprising the steps of:

repeating the process to simultaneously retreat from the second mine entry and advance into the third mine entry, wherein the second mine entry is operated as the former first mine entry and the third mine entry is operated as the former second mine entry.

* * * * *